US010128019B2

(12) United States Patent
Matsunaga et al.

(10) Patent No.: US 10,128,019 B2
(45) Date of Patent: Nov. 13, 2018

(54) COPPER ALLOY FOR ELECTRONIC/ELECTRICAL DEVICE, PLASTICALLY-WORKED COPPER ALLOY MATERIAL FOR ELECTRONIC/ELECTRICAL DEVICE, COMPONENT FOR ELECTRONIC/ELECTRICAL DEVICE, TERMINAL, AND BUSBAR

(71) Applicant: MITSUBISHI MATERIALS CORPORATION, Tokyo (JP)

(72) Inventors: Hirotaka Matsunaga, Okegawa (JP); Kazunari Maki, Saitama (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 0 days.

(21) Appl. No.: 15/743,175

(22) PCT Filed: Sep. 8, 2016

(86) PCT No.: PCT/JP2016/076387
§ 371 (c)(1),
(2) Date: Jan. 9, 2018

(87) PCT Pub. No.: WO2017/043559
PCT Pub. Date: Mar. 16, 2017

(65) Prior Publication Data

US 2018/0211741 A1 Jul. 26, 2018

(30) Foreign Application Priority Data

Sep. 9, 2015 (JP) ..... 2015-177743

(51) Int. Cl.
*H01B 5/02* (2006.01)
*H01B 1/02* (2006.01)
*C22F 1/08* (2006.01)

(52) U.S. Cl.
CPC ..... *H01B 1/026* (2013.01); *C22F 1/08* (2013.01); *H01B 5/02* (2013.01)

(58) Field of Classification Search
CPC ..... H01B 1/026; H01B 5/02; C22F 1/08
(Continued)

(56) References Cited

U.S. PATENT DOCUMENTS 3,778,318 A 12/1973 Hay et al.

FOREIGN PATENT DOCUMENTS

CN 102203916 A 9/2011
JP 61-284946 A 12/1986
(Continued)

OTHER PUBLICATIONS

International Search Report dated Dec. 6, 2016 for the corresponding PCT Application No. PCT/JP2016/076387.
(Continued)

*Primary Examiner* — Tremesha S Willis
(74) *Attorney, Agent, or Firm* — Leason Ellis LLP

(57) ABSTRACT

A copper alloy for an electronic and electric device includes: Mg in a range of 0.1 mass % or more and less than 0.5 mass %; and a Cu balance including inevitable impurities, wherein a graph, in which a vertical axis is $d\sigma_t/d\varepsilon_t$ and a horizontal axis is a true strain $\varepsilon_t$, $d\sigma_t/d\varepsilon_t$ being defined by a true stress $\sigma_t$ and the true strain $\varepsilon_t$, obtained in a tensile test of the copper alloy, has a strained region that has a positive slope of $d\sigma_t/d\varepsilon_t$.

10 Claims, 2 Drawing Sheets

(58) Field of Classification Search
USPC ..... 174/129 B
See application file for complete search history.

(56) References Cited

FOREIGN PATENT DOCUMENTS

| | | | |
|---|---|---|---|
| JP | 05-311283 | A | 11/1993 |
| JP | 2007-056297 | A | 3/2007 |
| JP | 2009-228013 | A | 10/2009 |
| JP | 2011-174127 | A | 9/2011 |
| JP | 2011-241412 | A | 12/2011 |
| JP | 2012-007231 | A | 1/2012 |
| JP | 5045783 | B | 10/2012 |
| JP | 2013-253267 | A | 12/2013 |
| JP | 2014-025089 | A | 2/2014 |
| JP | 2014-047378 | A | 3/2014 |
| JP | 2014-114464 | A | 6/2014 |

OTHER PUBLICATIONS

International Search Report dated Nov. 8, 2016 for the corresponding PCT Application No. PCT/JP2016/076362.
International Search Report dated Nov. 8, 2016 for the corresponding PCT Application No. PCT/JP2016/076376.
International Search Report dated Nov. 8, 2016 for the corresponding PCT Application No. PCT/JP2016/076456.
Notice of Allowance dated May 9, 2017 for the related Japanese Patent Application No. 2016-575989.
Office Action dated Apr. 4, 2018 for the corresponding Chinese Patent Application No. 201680008019.8.
David Chapman, "High Conductivity Copper for Electrical Engineering", May 31, 1998 [Retrieved from the Internet on Jul. 2, 2018].
R. Sundberg et al., "The Cu—Mg—P system: precipitation phenomena and physical properties", *Metals Technology*, Dec. 31, 1979, pp. 230-234, vol. 6, No. 1.
Extended European Search Report dated Jul. 11, 2018 for the related European Patent Application No. 16844412.3.

COPPER ALLOY FOR ELECTRONIC/ELECTRICAL DEVICE, PLASTICALLY-WORKED COPPER ALLOY MATERIAL FOR ELECTRONIC/ELECTRICAL DEVICE, COMPONENT FOR ELECTRONIC/ELECTRICAL DEVICE, TERMINAL, AND BUSBAR

CROSS-REFERENCE TO RELATED PATENT APPLICATIONS

This application is a U.S. National Phase Application under 35 U.S.C. § 371 of International Patent Application No. PCT/JP2016/076387 filed on Sep. 8, 2016 and claims the benefit of Japanese Patent Application No. 2015-177743, filed Sep. 9, 2015, all of which are incorporated herein by reference in their entireties. The International Application was published in Japanese on Mar. 16, 2017 as International Publication No. WO/2017/043559 under PCT Article 21(2).

FIELD OF THE INVENTION

The present invention relates to a copper alloy for an electronic and/or electric device (electronic/electric device), which is suitable for terminals such as connectors and press-fits and for components such as relays, lead frames and busbars; a plastically-worked copper alloy material for an electronic and electric device made of the copper alloy for an electronic and electric device; a component for an electronic and electric device; a terminal; and a busbar.

BACKGROUND OF THE INVENTION

Conventionally, highly conductive copper or copper alloy is used for an electronic or electric device such as terminals of connectors, press-fits, or the like; relays; lead frames; bus bars; and the like.

Generally, these parts for electronic and electric devices are produced by punching a rolled sheet having a thickness of about 0.05 to 2.0 mm to give a predetermined shape and bending at least a part of the rolled sheet. Materials constituting such parts for electronic and electric devices are required to have excellent bendability and high strength.

For example, Cu—Mg alloys are proposed in Japanese Unexamined Patent Application, First Publication No. 2011-241412 (A) as a material used for the electronic and electric device such as terminals of connectors, press-fits or the like; relays; lead frames; busbars; and the like. This Cu—Mg alloy is excellent in balance between strength, electric conductivity and bendability, and is particularly suitable as a material for parts for electronic and electric devices.

Technical Problem

Recently, high current and voltage are loaded on parts for electronic and electric devices occasionally. As a material of parts for electronic and electric devices, copper alloy materials with relatively thick thickness such as 1 mm, 2 mm and 3 mm are provided. For this reason, the copper alloy for electronic and electric devices described above is required to have excellent bendability at various thicknesses. In addition, since high current and voltage are applied on the parts, the above-mentioned copper alloy for electronic and electric devices is required to have high electrical conductivity.

The present invention is made under the circumstances described above. The purpose of the present invention is to provide a copper alloy for an electronic/electric device, a plastically-worked copper alloy material for an electronic or electric device, a component for an electronic or electric device, a terminal, and a busbar, all of which have particularly excellent bendability, and high electrical conductivity.

SUMMARY OF THE INVENTION

Solution to Problem

After conducting intensive studies, the inventors of the present invention obtained findings described below. When bending a relatively thin copper alloy material, since the bending process is performed with a small die, the area to be bent is narrow and deformation occurs locally. Therefore, the bendability is influenced by the local elongation. On the other hand, when bending a relatively thick copper alloy material, since the bending process is performed with a large die, the area to be bent is widened. For this reason, the bendability is influenced by the uniform elongation rather than the local elongation.

Here, in the case of a normal copper alloy material, when a tensile test is performed until the material breaks, $d\sigma_t/d\varepsilon_t$ ($\sigma_t$: true stress, $\varepsilon_t$: true strain) corresponding to the work hardening rate increases as the strain increases in the region of elastic deformation and plastic deformation monotonically decreases. However, as a result of conducting intensive studies by the inventors of the present invention, it was found that the above-mentioned $d\sigma_t/d\varepsilon_t$ rises after plastic deformation by performing a specific heat treatment on the copper alloy material.

Additionally, it is found that the uniform elongation is improved when $d\sigma_t/d\varepsilon_t$ rises after plastic deformation; and bendability is improved even when thickness of the copper alloy material is relatively thick.

The present invention is made based on the above-describe findings. An aspect of the present invention is a copper alloy for an electronic and electric device (hereinafter, referred as "the copper alloy for an electronic and electric device of the present invention") including: Mg in a range of 0.1 mass % or more and less than 0.5 mass %; and a Cu balance including inevitable impurities, wherein a graph, in which a vertical axis is $d\sigma_t/d\varepsilon_t$ and a horizontal axis is a true strain $\varepsilon_t$, $d\sigma_t/d\varepsilon_t$ being defined by a true stress $\sigma_t$ and the true strain $\varepsilon_t$, obtained in a tensile test of the copper alloy, has a strained region that has a positive slope of $d\sigma_t/d\varepsilon_t$.

According to the copper alloy for an electronic and electric device configured as described above, a graph, in which a vertical axis is $d\sigma_t/d\varepsilon_t$ and a horizontal axis is a true strain $\varepsilon_t$, $d\sigma_t/d\varepsilon_t$ being defined by a true stress $\sigma_t$ and the true strain $\varepsilon_t$, obtained in a tensile test of the copper alloy, has a strained region that has a positive slope of $d\sigma_t/d\varepsilon_t$ for $d\sigma_t/d\varepsilon_t$ to be increased after plastic deformation. Thereby, uniform elongation is improved. As a result, bendability can be improved even when thickness of the copper alloy material is relatively thick.

In addition, since the content of Mg is relatively low at less than 0.5 mass %, high conductivity can be obtained. In addition, since the content of Mg is set to 0.1 mass % or more, heat resistance is secured; and significant reduction of the 0.2% proof stress can be suppressed even when a specific heat treatment is performed so as to have a strain region where the $d\sigma_t/d\varepsilon_t$ is positive.

In the above-described copper alloy for an electronic and electric device of the present invention, the electrical conductivity may be 70% IACS or more.

In this case, since the conductivity is 70% IACS or more, it can also be applied to applications where pure copper was conventionally used.

In addition, in the above-described copper alloy for an electronic and electric device of the present invention, a rise value of the $d\sigma_t/d\varepsilon_t$ may be 30 MPa or more.

In this case, since the amount of increase in dσt/dεt is set to 30 MPa or more, the uniform elongation is reliably improved and particularly excellent bendability can be obtained.

In addition, the above-described copper alloy for an electronic and electric device of the present invention may further include P in a range of 1 mass ppm or more and less than 100 mass ppm.

In this case, since P is contained by 1 mass ppm or more, castability can be improved. In addition, since the content of P is less than 100 mass ppm, it is possible to suppress significant decrease in conductivity even when P is added.

In addition, the above-described copper alloy for an electronic and electric device of the present invention may further include Sn in a range of 10 mass ppm or more and less than 1000 mass ppm.

In this case, since Sn is contained at 10 mass ppm or more, the heat resistance can be improved, and it is possible to reliably suppress the decrease in the 0.2% proof stress after the heat treatment. In addition, since the content of Sn is less than 1000 mass ppm, it is possible to suppress significant decrease of in conductivity even when Sn is added.

In addition, in the above-described copper alloy for an electronic and electric device of the present invention, a H content may be less than 4 mass ppm, an O content may be less than 10 mass ppm, and a S content may be less than 50 mass ppm.

In this case, since the content of H is less than 4 mass ppm, the occurrence of blowhole defects in the ingot can be suppressed.

In addition, since the content of O is less than 10 mass ppm and the content of S is less than 50 mass ppm, the consumption of Mg by the reaction with O and S is suppressed; and the effect of improving the 0.2% proof stress and the stress relaxation resistance by Mg can be reliably obtained. Furthermore, since formation of a compound of Mg with O and/or S is suppressed, there is less compounds to be a starting point of breakage in the matrix for the cold workability and the bendability to be improved.

Other aspect of the present invention is a plastically-worked copper alloy material for an electronic and electric device (hereinafter, referred as "the plastically-worked copper alloy material for an electronic and electric device of the present invention") made of the above-described copper alloy for an electronic and electric device of the present invention.

According to the plastically-worked copper alloy material for an electronic and electrical device configured as described above, since it is constituted by the above-mentioned copper alloy for an electronic and electric device, an electronic and electric device having excellent characteristics can be produced by performing bending work on the plastically-worked copper alloy material.

Other aspect of the present invention is a component for an electronic and electric device (hereinafter, referred as "the component for an electronic and electric device of the present invention") made of the above-described plastically-worked copper alloy material for an electronic and electric device of the present invention. In the present invention, the parts for an electronic and electric device include terminals of connectors, press fit or the like; relays; lead frames; bus bars and the like.

Since the component for an electronic and electric device configures as described above is produced by using the above-mentioned plastically-worked copper alloy material for an electronic and electrical device, bending work is performed appropriately; and the component has excellent reliability.

Other aspect of the present invention is a terminal (hereinafter, referred as "the terminal of the present invention") made of the above-described plastically-worked copper alloy material for an electronic and electric device of the present invention.

Since the terminal configured as described above is produced by using the above-described plastically-worked copper alloy material for an electronic and electric device, bending work is performed appropriately; and the terminal has excellent reliability.

Other aspect of the present invention is a busbar (hereinafter, referred as "the busbar of the present invention") made of the above-described plastically-worked copper alloy material for an electronic and electric device of the present invention.

Since the busbar configured as described above is produced by using the above-described plastically-worked copper alloy material for an electronic and electric device, bending work is performed appropriately; and the busbar has excellent reliability.

Advantageous Effects of Invention

According to the present invention, a copper alloy for an electronic and electric device; a plastically-worked copper alloy material for an electronic and electric device; a component for an electronic and electric device; a terminal; and a busbar, each of which has particularly excellent bendability, and high electrical conductivity, can be provided.

DETAILED DESCRIPTION OF THE INVENTION

Figure 1:
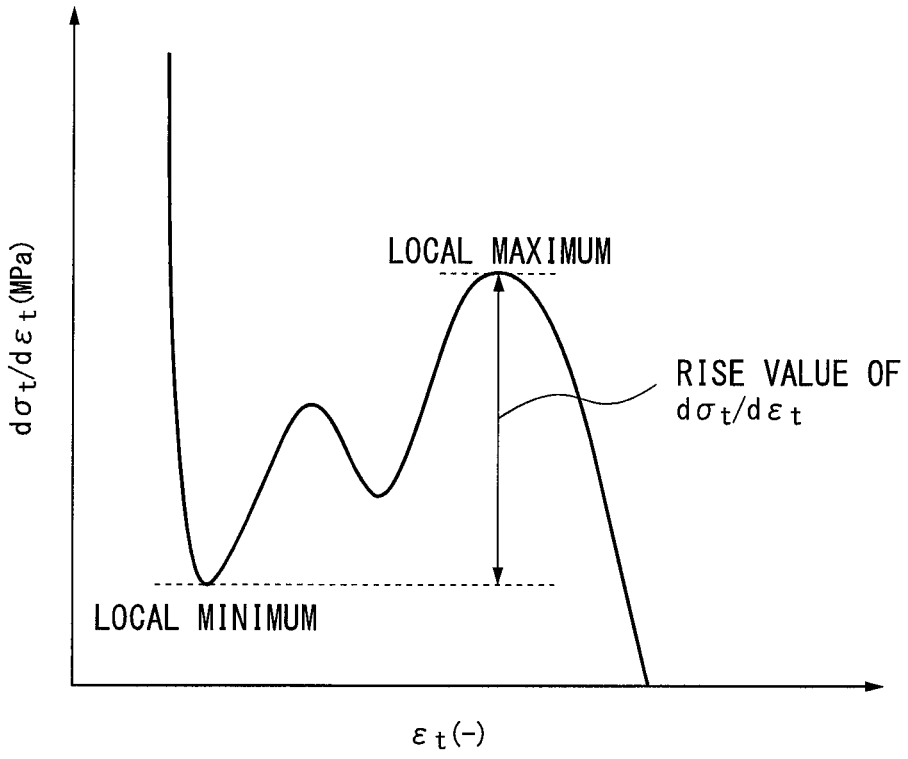
FIG. 1 is a graph showing the relationship between $d\sigma_t/d\varepsilon_t$ (work-hardening rate) and $\varepsilon_t$ (true strain) in a copper alloy for an electronic and electric device according to this embodiment.

A copper alloy for an electronic and electric device, which is an embodiment of the present invention, is explained below.

The copper alloy for an electronic and electric device of the present embodiment has a composition including: Mg in a range of 0.1 mass % or more and less than 0.5 mass %; and a Cu balance including inevitable impurities.

In addition, in the copper alloy for an electronic and electric device of the present embodiment, it is preferable that a H content is less than 4 mass ppm, an O content is less than 10 mass ppm, and a S content is less than 40 mass ppm.

In addition, the copper alloy for an electronic and electric device of the present embodiment may further include P in a range of 1 mass ppm or more and less than 100 mass ppm. In addition, the copper alloy for an electronic and electric device of the present embodiment may further include Sn in a range of 10 mass ppm or more and less than 1000 mass ppm.

In addition, in the copper alloy for an electronic and electric device of the present embodiment, a graph, in which a vertical axis is $d\sigma_t/d\varepsilon_t$ and a horizontal axis is a true strain $\varepsilon_t$, $d\sigma_t/d\varepsilon_t$ (work-hardening rate) being defined by a true stress $\sigma_t$ and the true strain $\varepsilon_t$, obtained in a tensile test until the material breaks, has a strained region that has a positive slope of $d\sigma_t/d\varepsilon_t$ ($d(d\sigma_t/d\varepsilon_t)/d\varepsilon_t$).

In the present embodiment, the rise value of $d\sigma_t/d\varepsilon_t$ is set to 30 MPa or more.

Here, the relationship between $d\sigma_t/d\varepsilon_t$ (work-hardening rate) and $\varepsilon_t$ (true strain) will be explained in reference to the drawing.

In the copper alloy for an electronic and electrical device of the present embodiment, $d\sigma_t/d\varepsilon_t$ increases after plastic working as shown in FIG. 1. Although, $d\sigma_t/d\varepsilon_t$ fluctuates after turning to rise as shown in FIG. 1 occasionally, it suffices if $d\sigma_t/d\varepsilon_t$ has the region rising after plastic deformation. The rise value of $d\sigma_t/d\varepsilon_t$ is defined as the difference between the local minimum and maximum values of $d\sigma_t/d\varepsilon_t$ as shown in FIG. 1.

The minimum value of $d\sigma_t/d\varepsilon_t$ referred to here is a point in the true strain $\varepsilon_t$ region smaller than that of the local maximum value on the graph and a point where the inclination changes from negative to positive. If there are multiple minimum values, the minimum value of $d\sigma_t/d\varepsilon_t$ having the lowest value is used for calculation of the rise value of $d\sigma_t/d\varepsilon_t$.

The maximum value of $d\sigma_t/d\varepsilon_t$ referred to here is a point where the slope changes from positive to negative on the graph. If there are multiple maximum values, the maximum value of $d\sigma_t/d\varepsilon_t$ having the highest value among them is used for calculation of the rise value of $d\sigma_t/d\varepsilon_t$.

In addition, the copper alloy for an electronic and electrical device according to the present embodiment has characteristics such that the 0.2% proof stress is 300 MPa or more and the conductivity is 70% IACS or more. Further, the half-softening temperature, which is obtained by performing heat treatments for 1 hour at each temperature in accordance with JCBA T 315: 2002 "Test on annealing softening properties of copper and copper alloy strips", is set to 250° C. or more.

Reasons for setting the component compositions and $d\sigma_t/d\varepsilon_t$ as described above are explained below.

(Mg: 0.1 Mass % or More and Less than 0.5 Mass %)

Mg is an element having the effect of improving the 0.2% yield strength and heat resistance. In order to "have a strain region that has a positive slope of $d\sigma_t/d\varepsilon_t$", heat treatment is performed under conditions of high temperature for a long time as described later. For this reason, in the copper alloy for an electronic and electric device of the present embodiment, it is necessary to contain Mg in order to ensure sufficient heat resistance.

If the Mg content were less than 0.1 mass %, there would be a possibility that the above-described effect cannot be obtained sufficiently and the 0.2% yield strength after the heat treatment reduces significantly. On the other hand, if the Mg content were 0.5 mass % or more, there would be a possibility that the electrical conductivity is reduced; and it becomes unsuitable for applications as parts for an electronic and electric device on which high load large current and voltage are loaded.

Accordingly, the Mg content is set to the range of 0.1 mass % or more and less than 0.5 mass % in the present embodiment.

In order to reliably improve 0.2% yield strength and heat resistance, it is preferable that the lower limit of the Mg content is set 0.15 mass % or more. It is more preferable that the lower limit of the Mg content is set to 0.2 mass % or more. In addition, in order to reliably suppress reduction of the electrical conductivity, it is preferable that the upper limit of the Mg content is set to 0.45 mass % or less. It is more preferable that the upper limit of the Mg content is set to 0.40 mass % or less. It is most preferable that the upper limit of the Mg content is set to 0.30 mass % or less.

(P: 1 Mass Ppm or More and Less than 100 Mass Ppm)

Since P is an element having effect of improving castability, it may be appropriately added depending on the intended use.

If the P content were less than 1 mass ppm, there would be a possibility that the above-described effect cannot be obtained sufficiently. On the other hand, if the P content were 100 mass ppm or more, there would be a possibility that the electrical conductivity is reduced significantly.

Accordingly, the P content is set to the range of 1 mass ppm or more and less than 100 mass ppm in the present embodiment of adding P. In order to reliably suppress the reduction of the electrical conductivity, it is preferable that the upper limit of the P content is set to less than 50 mass ppm. It is more preferable that the upper limit of the P content is set to less than 30 mass ppm. Most preferably, it is set to less than 20 mass ppm.

In addition, it is acceptable that less than 1 mass ppm of P is included as inevitable impurity. Thus, there is no restriction for the lower limit of the P content in the case where improvement of castability by P is not intended.

(Sn: 10 Mass Ppm or More and Less than 1000 Mass Ppm)

Since Sn has effect of further improving 0.2% proof stress and heat resistance, it may be appropriately added depending on the intended use.

If the Sn content were less than 10 mass ppm, there would be a possibility that the above-described effect cannot be obtained sufficiently. On the other hand, if the Sn content were 1000 mass ppm or more, there would be a possibility that the electrical conductivity is reduced significantly.

Accordingly, the Sn content is set to the range of 10 mass ppm or more and less than 1000 mass ppm in the present embodiment of adding Sn. In order to reliably suppress the reduction of the electrical conductivity, it is preferable that the upper limit of the Sn content is set to less than 500 mass ppm. It is more preferable that the upper limit of the Sn content is set to less than 100 mass ppm. Even more preferably, it is set to less than 50 mass ppm.

In addition, it is acceptable that less than 10 mass ppm of Sn is included as inevitable impurity. Thus, there is no restriction for the lower limit of the Sn content in the case where improvement of 0.2% yield strength and heat resistance by Sn is not intended.

(H (Hydrogen): Less than 4 Mass Ppm)

H is an element that causes blowhole defects in the ingot. This blowhole defect causes cracks during casting and defects such as swelling and peeling during rolling. It is known that these defects such as cracks, swelling and peeling deteriorate 0.2% yield strength and stress corrosion cracking characteristics since stress are concentrated on these defects to be start points of breakage. In particular, in the case of a copper alloy containing Mg, MgO and H are formed by the reaction of Mg and $H_2O$ as solute components at the time of dissolution. Therefore, when the vapor pressure of $H_2O$ is high, H is likely to dissolve in the melt in a large amount, which leads to the above-mentioned defects. Thus, it is necessary to strictly limit the H content.

For this reason, the H content is limited to less than 4 mass ppm in the present embodiment. In order to further suppress the occurrence of blowhole defects, the H content is preferably set to less than 2 mass ppm, more preferably set to less than 1 mass ppm. Even more preferably, it is set to less than 0.5 mass ppm.

(O (Oxygen): Less than 10 Mass Ppm)

O is an element inevitably included from the atmosphere and the like and reacts with Mg to form an oxide. Since this oxide serves as a starting point of breakage, cracks are likely to occur during cold working or bending. In addition, Mg reacts with O to be consumed, and the amount of dissolving Mg decreases, so that there is a possibility that 0.2% yield strength and stress relaxation resistance characteristics cannot be sufficiently improved.

For this reason, the O content is limited to less than 10 mass ppm in the present embodiment. Within the above-described range, the O content is preferably set to less than 5 mass ppm, more preferably set to less than 3 mass ppm. Most preferably, it is set to less than 2 mass ppm.

(S (Sulfur): Less than 50 Mass Ppm)

S is present in grain boundaries in the form of sulfides, intermetallic compounds or composite sulfides of Mg and the like.

The sulfides, intermetallic compounds or composite sulfides of Mg present at the crystal grain boundary causes grain boundary cracking during hot working and causes processing cracks. In addition, the since sulfides, intermetallic compounds or composite sulfides of Mg serves as a starting point of breakage, cracks are likely to occur during cold working or bending. In addition, Mg reacts with S to be consumed, and the amount of dissolving Mg decreases, so that there is a possibility that 0.2% yield strength and stress relaxation resistance characteristics cannot be sufficiently improved.

For this reason, the S content is limited to less than 50 mass ppm in the present embodiment. Within the above-described range, the S content of is preferably set to less than 20 mass ppm, more preferably set to less than 10 mass ppm.

(Inevitable Impurities: 0.1 Mass % or Less)

As other inevitable impurities, B, Cr, Ti, Fe, Co, O, S, C, (P), Ag, (Sn), Al, Zn, Ca, Te, Mn, Sr, Ba, Sc, Y, Zr, Hf, V, Nb, Ta, Mo, W, Re, Ru, Os, Se, Rh, Ir, Pd, Pt, Au, Cd, Ga, In, Li, Ge, As, Sb, Tl, Pb, Be, N, H, Hg, Tc, Na, K, Rb, Cs, Po, Bi, lanthanoids, Ni, Si, or the like can be named. Since these inevitable impurities have an effect of lowering the electrical conductivity, it is desirable that they are less even. When scrap is used as a raw material, it is preferable that the total amount of inevitable impurities is 0.1 mass % or less, more preferably 0.09 mass % or less. Even more preferably, it is kept at 0.08 mass % or less.

In terms of Ag, Si, and Zn, since they are easily incorporated into copper to lower the electrical conductivity, it is preferable that the total amount is kept less than 100 mass ppm.

The upper limit of each element is preferably 200 mass ppm or less, more preferably 100 mass ppm or less. Most preferably, it is 50 mass ppm or less.

($d\sigma_t/d\varepsilon_t$)

Normally, in a standard copper alloy, $d\sigma_t/d\varepsilon_t$ monotonically decreases when a tensile test is performed until the material breaks. On the other hand, in the copper alloy for an electronic and electrical device of this embodiment, there is a region in which $d\sigma_t/d\varepsilon_t$ increases after plastic working in the graph as shown in FIG. 1. In order to satisfy the above-described configuration, it is necessary to perform a finishing heat treatment at a temperature higher than usual for a long time with the crystal grain size and its uniformity controlled as described later.

When finishing heat treatment is performed under conditions of higher temperature and longer time than usual in a state where the crystal grain size and uniformity are controlled, the dislocation structure in the material shifts to a stable dislocation structure. When an external force is applied to this stable dislocation structure, $d\sigma_t/d\varepsilon_t$ temporarily decreases at the beginning of plastic deformation. Then, after $d\sigma_t/d\varepsilon_t$ decreases, the interaction between dislocations becomes stronger than usual, and $d\sigma_t/d\varepsilon_t$ increases.

Here, by setting the rise value of $d\sigma_t/d\varepsilon_t$ to 30 MPa or more, the uniform elongation is further improved and it is possible to have excellent bendability. In order to further improve the uniform elongation, the rise value of $d\sigma_t/d\varepsilon_t$ is preferably set to 50 MPa or more, more preferably set to 100 MPa or more. Even more preferably, it is set to 150 MPa or more.

(0.2% Yield Strength after Finish Heat Treatment: 300 MPa or More)

In the copper alloy for an electronic and electric device of the present embodiment, by setting the 0.2% yield strength after the finish heat treatment to 300 MPa or more, it is possible to obtain a material particularly suitable for an electronic and electric device for terminals such as connectors and press-fits, relays, lead frames, busbars or the like. In this embodiment, 0.2% yield strength after the finish heat treatment in a tensile test performed in the direction perpendicular to the rolling direction.

It is preferable that 0.2% yield strength is set to 325 MPa or more, more preferably to 350 MPa.

(Electrical Conductivity: 70% IACS or More)

The copper alloy for an electronic or electric device of the present embodiment can be suitably used as a component for an electronic or electric device such as: terminals of connectors, press-fits, or the like; relays; lead frames; busbars; and the like by setting the electric conductivity to 70% IACS or more.

It is preferable that the electrical conductivity is set to 73% IACS or more, and more preferably set to 76% IACS or more. Even more preferably, it is set to 78% IACS or more.

Figure 2:
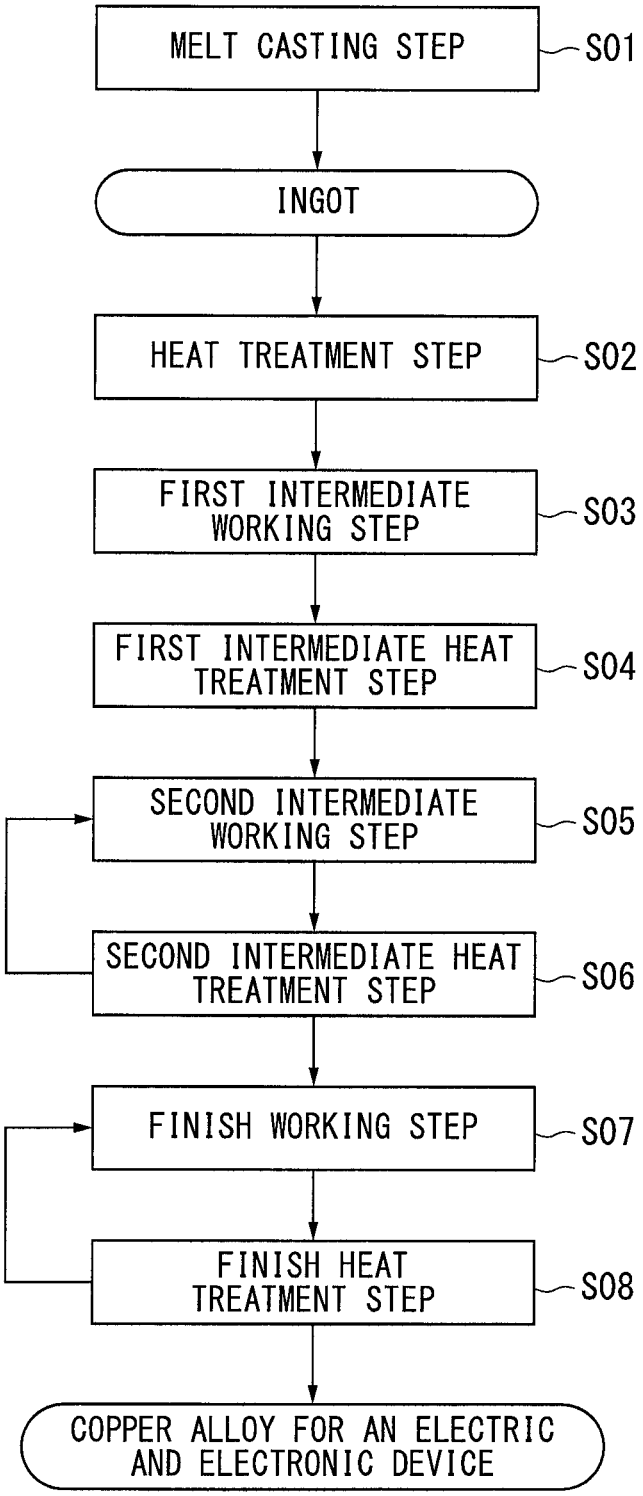
FIG. 2 is a flowchart of a method of producing the copper alloy for an electronic and electric device of an embodiment of the present invention.

Next, a method of producing a copper alloy for an electronic and electric device of the present embodiment as configured above is explained in reference to the flowchart in FIG. 2.

(Melting and Casting Step S01)

First, components are adjusted by adding the above-described elements to molten copper obtained by melting a copper raw material, thereby producing a molten copper alloy. Meanwhile, as each of elements added, it is possible to use a single body of the element, an alloy of the element, or the like. In addition, a raw material including the element may be melted together with the copper raw material. In addition, a recycled material or a scrapped material of the present alloy may also be used. Here, the molten copper is preferably a so-called 4NCu having purity set to 99.99% by mass or more: or a so-called 5NCu having purity set to 99.999% by mass or more. In the melting step, it is preferable to perform atmosphere melting in an inert gas atmosphere with a low vapor pressure of $H_2O$ (Ar gas, for example) and keep the retention time in melting to the minimum in order to suppress oxidation of Mg; and reduce the hydrogen concentration.

Then, the ingot is produced by pouring the copper alloy melt with the adjusted component composition. In consideration of mass production, it is preferable that the continuous casting method or the semi-continuous casting method is used.

(Heat Treatment Step S02)

Next, a heating treatment is carried out in order for homogenization of the obtained ingot and formation of a solid solution. By heating the ingot, the additive element is homogeneously diffused in the ingot, or the additive element is solid-solved in the matrix.

Next, heat treatment is performed for homogenization and heat solution treatment of the obtained ingot. Inside the ingot, an intermetallic compound including Cu and Mg as major components which is generated by Mg being condensed due to segregation in a solidification step is present. Therefore, in order to remove or reduce the segregation and the intermetallic compound, a heating treatment in which the ingot is heated to a temperature in a range of 300° C. to 900° C. is carried out, thereby homogeneously dispersing Mg or dissolving Mg in the matrix in the ingot. Meanwhile, this heat treatment step S02 is preferably carried out in a non-oxidizing or reducing atmosphere.

In addition, hot working may be carried out after the heat treatment in order to increase the efficiency of the rough working and the uniformity of the structure. The processing method is not particularly limited, but for example, rolling, drawing, extrusion, groove rolling, forging, pressing and the like can be adopted. It is preferable to use rolling in the case where the final shape of the product is in a plate or strip. In addition, the temperature during hot working is also not particularly limited, but it is preferably in the range of 300° C. to 900° C.

(First Intermediate Working Step S03)

Next, the material after the heat treatment step S02 is cut as necessary, and surface grinding is carried out as necessary in order to remove oxide scale and the like. Thereafter, plastic working to a predetermined shape is performed.

The temperature condition in the first intermediate working step S03 is not particularly limited, but it is preferable to set it within the range of −200° C. to 200° C., which corresponds to cold or warm working. Further, although the processing rate is appropriately selected so as to approximate the final shape, it is preferably 30% or more, more preferably 35% or more. Even more preferably, it is set to 40% or more. In addition, although the plastic working method is not particularly limited, for example, rolling, drawing, extrusion, groove rolling, forging, pressing and the like can be adopted.

(First Intermediate Heat Treatment Step S04)

After the first intermediate working step S03, heat treatment is performed for the purpose of softening for ensuring thorough heat solution treatment, forming a recrystallization organization or improvement of workability.

The heat treatment method is not particularly limited, but heat treatment is preferably performed in a non-oxidizing atmosphere or a reducing atmosphere at a holding temperature of 400° C. or more and 900° C. or less, a retention time of 10 seconds or more and 10 hours or less. The cooling method after heating is not particularly limited, but it is preferable to adopt a method in which the cooling rate is 200° C./min or more, such as water quenching.

(Second Intermediate Working Step S05)

Surface grinding is performed as necessary in order to remove the oxide scale and the like generated in the first intermediate heat treatment step S04. Then, plastic working to a predetermined shape is performed.

The temperature condition in this second intermediate processing step S05 is not particularly limited, but it is preferable to set it within the range of −200° C. to 200° C., which corresponds to cold or warm working. In addition, although the processing rate is appropriately selected so as to approximate the final shape, it is preferably 20% or more, and more preferably 30% or more. In addition, although the plastic working method is not particularly limited, for example, rolling, drawing, extrusion, groove rolling, forging, pressing and the like can be adopted.

(Second Intermediate Heat Treatment Step S06)

After the second intermediate processing step S05, heat treatment is performed for the purpose of softening for ensuring thorough heat solution treatment, forming recrystallization organization or improvement of workability. The heat treatment method is not particularly limited, but heat treatment is preferably performed in a non-oxidizing atmosphere or a reducing atmosphere at a retention temperature of 400° C. or more and 900° C. or less, a retention time of 10 seconds or more and 10 hours or less. The cooling method after heating is not particularly limited, but it is preferable to adopt a method in which the cooling rate is 200° C./min or more, such as water quenching.

In the present embodiment, in order to control the crystal grain size and its uniformity before carrying out the finish working step S07 and the finish heat treatment step S08 which will be described later, the above-described second intermediate working step S05 and second intermediate heat treatment step S06 are repeated as many times as necessary.

Specifically, until the average grain size is 2 μm or more and the standard deviation of the crystal grain size is d or less when the average grain size is defined as "d", the second intermediate processing step S05 and the second intermediate heat treatment step S06 are repeatedly performed.

Here, by setting the average grain size to 2 μm or more before the finish working step S07, the softening temperature in the finish heat treatment step S08 can be increased; the heat treatment condition can be set to a high temperature and a long time; and the uniform elongation can be improved. The average grain size before the finish working step S07 is preferably 4 μm to 70 μm, more preferably 5 μm to 40 μm.

Further, if the standard deviation of the crystal grain size is set to be equal to or less than the average grain size d before the finish working step S07, it is possible to uniformly apply the strain in the finish working step S07. Thus, strength of the interaction between dislocations is the material can be uniformly improved further. Accordingly, $d\sigma_t/d\varepsilon_t$ can be increased reliably. The standard deviation of the grain size before the finish working step S07 is preferably set to d/2 or less when the average grain size d is 60 μm or less.

(Finish Working Step S07)

The copper material after the second intermediate heat treatment step S06 is finished into a predetermined shape. The temperature condition in this finish working step S07 is not particularly limited, but in order to suppress precipitation, it is preferable to set it within the range of −200° C. to 200° C., which corresponds to cold or warm working.

In addition, by setting the processing rate (rolling rate) in the finish working step S07 to be more than 30%, the 0.2% yield strength can be improved. In order to further improve the 0.2% yield strength, it is more preferable to set the processing ratio (rolling ratio) to be more than 40%, more preferably to be more than 50%.

(Finish Heat Treatment Step S08)

Next, a finish heat treatment is performed on the copper material obtained in the finish working step S07. The finish heat treatment temperature is preferably 300° C. or more. For example, when the retention time is 1 min or more in the case of 300° C., the retention time is preferably 5 sec or more in the case of 450° C. In addition, it is preferable to carry out the finish heat treatment in non-oxidizing atmosphere or reducing atmosphere.

The cooling method after heating is not particularly limited, but it is preferable to adopt a method in which the cooling rate is 60° C./min or more, such as water quenching.

The above-described finish working step S07 and finish heat treatment step S08 may be repeated multiple times.

In this way, the copper alloy for an electronic and electrical device and the plastically-worked copper alloy material for and electronic and electrical device according to this embodiment are produced. The plastically-worked copper alloy material for and electronic and electric device may be used as it is for parts for an electronic and electric device. Alternatively, Sn plating having a thickness of about 0.1 to 10 μm is applied to one side or both sides of the plate surface made of the plastically worked material, and used as a copper alloy material with plating.

In addition, the component for an electronic and electric device such as terminals of connectors, press-fits, or the like; relays; lead frames; bus bars; and the like, is formed by performing punching processing, bending, or the like using the copper alloy for an electronic and electric device of the present embodiment (the plastically-worked copper alloy material for and electronic and electrical device) as the material.

According to the copper alloy for an electronic and electric device of the present embodiment as configured described above, the graph, in which the vertical axis is $d\sigma_t/d\varepsilon_t$ and the horizontal axis being $\varepsilon_t$, $d\sigma_t/d\varepsilon_t$ being defined by the true stress $\sigma_t$ and the true strain $\varepsilon_t$, obtained in a tensile test of the copper alloy, has a strained region that has a positive slope of $d\sigma_t/d\varepsilon_t$ (work-hardening rate); and $d\sigma_t/d\varepsilon_t$ increases after beginning of plastic deformation, thereby the uniform elongation is improved. Therefore, the copper alloy for an electronic and electric device of the present embodiment has particularly excellent bendability.

In particular, in the present embodiment, since the rise value of $d\sigma_t/d\varepsilon_t$ is set to 30 MPa or more, it is possible to reliably improve uniform elongation and further improve bendability.

In addition, in the present embodiment, since the copper alloy contains 0.1 mass % or more of Mg, it is excellent in heat resistance; and high 0.2% yield strength can be kept without significantly deteriorating the 0.2% yield strength even when heat treatment at high temperature for a long time is performed in the finish heat treatment step S08.

Furthermore, in the present embodiment, since the content of Mg is limited to less than 0.5 mass %, high electrical conductivity can be obtained.

In the present embodiment, when P is contained in the range of 1 mass ppm or more and less than 100 mass ppm, the castability can be improved without significantly reducing the electrical conductivity.

Further, in the present embodiment, when Sn is contained in the range of 10 mass ppm or more and less than 1000 mass ppm, it is possible to further improve the heat resistance without significantly reducing the electrical conductivity.

In the present embodiment, when the H content is limited to less than 4 mass ppm, occurrence of defects such as cracks, swelling, peeling and the like caused by blowhole defects can be suppressed.

Furthermore, in the present embodiment, when the O content is limited to less than 10 mass ppm and the S content is restricted to less than 50 mass ppm, consumption of Mg due to formation of compounds with elements such as O and S is suppressed; and the effect of reliably improving 0.2% yield strength and the stress relaxation resistance because of Mg. In addition, by suppressing the formation of compounds of Mg with elements such as O and S, cold workability and bendability can be improved.

Furthermore, in the copper alloy for an electronic and electrical device according to the present embodiment, 0.2% yield strength is set to 300 MPa or more when the tensile test is performed in the direction perpendicular to the rolling direction; and the electrical conductivity is set to 70% IACS or more. Therefore, the copper alloy is particularly suitable as a material of an electronic and electric device for terminals such as connectors and press-fits, relays, lead frames, busbars or the like.

In addition, in the copper alloy for an electronic and electric device according to the present embodiment, the half-softening temperature, which is obtained by performing heat treatments for 1 hour at each temperature in accordance with JCBA T 315: 2002 "Test on annealing softening properties of copper and copper alloy strips", is set to 250° C. or more. Thus, it is possible to suppress reduction of 0.2% yield strength in the finish heat treatment step S08.

In addition, since the plastically-worked copper alloy material for an electronic and electric device of the present embodiment is made of the above-described copper alloy for an electronic and electric device, a component for an electronic and electric device such as terminals of connectors, press-fits, or the like; relays; lead frames; bus bars; and the like can be produced by performing bending or the liken on this plastically-worked copper alloy material for an electronic and electric device.

In addition, since the component for an electronic and electric device of the present embodiment (such as terminals of connectors, press-fits, or the like; relays; lead frames; bus bars; and the like) is made of the above-described copper alloy for an electronic and electric device, excellent reliability can be obtained.

Thus far, the copper alloy for an electronic and electric device, the plastically-worked copper alloy material for an electronic and electric device, and the component (terminals, and busbars), which are embodiments of the present invention, have been described, but the present invention is not limited thereto and can be appropriately modified within the scope of the technical concept of the invention.

For example, in the above-described embodiments, examples of the method for producing the copper alloy for an electronic and electric device has been described, but the production methods are not limited to the present embodiments, and the copper alloy for an electronic and electric device may be produced by appropriately selecting an existing manufacturing method.

EXAMPLES

The results of confirmatory experiments conducted to confirm the effect of the present invention will be described below.

A copper raw material made of oxygen-free copper (ASTM B 152 C 10100) having a purity of 99.99 mass % or more with the H content less than 0.5 mass ppm, the O content less than 2 mass ppm, the S content less than 10 mass ppm was prepared. The copper raw material was placed in a high purity graphite crucible and melted at high frequency in an atmosphere furnace of the Ar gas atmosphere. Various additive elements were added into the resulting molten copper to prepare the composition shown in Table 1, and the ingot was poured into a carbon mold to produce an ingot.

At this time, in Examples 7, 11 and 16 of the present invention, steam was introduced into the Ar gas atmosphere and high frequency melting was carried out. In Example 9 of the present invention, slight amount of $O_2$ was introduced into the atmosphere during dissolution to produce an ingot. In Examples 3, 10 and 17 of the present invention, a Cu—S master alloy was added.

The size of the ingot was about 80 mm thick×150 mm wide×70 mm long.

The vicinity of the casting surface of the ingot was chamfered and the ingot was cut out so that the final product had a thickness of 0.5 mm, 1.0 mm, and 2.0 mm for the size to be adjusted.

For homogenization and solution, the obtained ingot was subjected to a heat treatment step at the retention temperature and for the retention time shown in Table 2 in an Ar gas atmosphere, and thereafter water quenching was carried out.

Surface grinding was performed to cut the material after heat treatment and to remove oxide scale.

Next, after performing cold rolling at the reduction rate shown in Table 2 as the first intermediate working step, heat treatment was performed at a temperature and retention time shown in Table 2 using a salt bath as the first intermediate heat treatment. In Table 1, the first intermediate working step is referred to as "intermediate rolling 1", and the first intermediate heat treatment step as "intermediate heat treatment 1."

Next, after performing cold rolling at the reduction rate shown in Table 2 as the second intermediate processing step, heat treatment was performed at the temperature and retention time shown in Table 2 using a salt bath as the second intermediate heat treatment. In Table 1, the second intermediate working step and the second intermediate heat treatment step for the first time are indicated as "intermediate rolling 2" and "intermediate heat treatment 2", respectively.

Further, cold rolling was carried out at the rolling rate shown in Table 2 as the second intermediate working step, and then heat treatment was performed at a temperature and retention time shown in Table 2 using a salt bath as a second intermediate heat treatment for the second time. In Table 2, the second intermediate working step and the second intermediate heat treatment step for the second time are indicated as "intermediate rolling 3" and "intermediate heat treatment 3", respectively.

Then, the crystal grain size before the finish work step was measured. A sample was taken from the material after the second intermediate heat treatment step for the second time; and a cross section orthogonal to the rolling direction was observed to measure the average value and the standard deviation of the crystal grain size. After mechanical polishing using waterproof abrasive paper and diamond abrasive grains, finish polishing was performed using a colloidal silica solution. Then, using an EBSD measuring apparatus (Quanta FEG 450 manufactured by FEI, and OIM Data Collection manufactured by EDAX/TSL (currently AMETEK)) and analysis software (OIM Data Analysis ver.5.3 manufactured by EDAX/TSL (currently AMETEK)), an orientation difference of each crystal grain was analyzed with an acceleration voltage of 20 kV of an electron beam and a measurement area of 1000 $\mu m^2$ or more at a measurement interval of 0.1 μm steps. The CI value of each measurement point was calculated by analysis software OIM, and from the analysis of crystal grain size, those with CI value of 0.1 or less were excluded. As a result of the two-dimensional cross section observation of the crystal grain boundary, a crystal grain boundary map was created with a grain boundary excluding twin crystals from between measurement points where the orientation difference between two adjacent crystals is 15° or more. In the method of measuring the crystal grain size, the crystal grain size was defined as the average value of the major axis of a crystal grain (the length of a straight line that can be drawn the longest in the grain in a state not in contact with the grain boundary in the middle) and the minor axis the crystal grain (the length of a straight line that can be drawn the longest in the grain in a state not in contact with the grain boundary in the middle in the direction intersecting the major axis in the right angle). By using this method, crystal grain sizes of 200 crystal grains were measured for each sample, and the average value and the standard deviation of crystal grain sizes were calculated. The results are shown in Table 3.

Next, finish rolling was performed on the material after the second intermediate heat treatment step for the second time at the rolling rate shown in Table 3 to obtain the plate thickness shown in Table 3 (thickness: 0.5 mm, 1.0 mm, 2.0 mm), a width of 150 mm, and a length of 200 mm or more.

Next, in a Ar gas atmosphere, a finish heat treatment was carried out at the temperature and retention time shown in Table 3 to prepare a strip for characteristic evaluation.

(Mechanical Property Evaluation)

No. 13B test specimen specified in JIS Z 2201 was sampled from a material before finish heat treatment and strip material for characteristic evaluation after the finish heat treatment; and 0.2% yield strength was measured by the offset method of JIS Z 2241. At that time, the strain rate was 0.7 mm/s, and the test force and the displacement of the test piece were obtained every 0.01 s. The test piece was taken so that the tensile direction of the tensile test was orthogonal to the rolling direction of the characteristic evaluation strip. The measurement results are shown in Table 3.

In addition, the true stress σt and the true strain Ft were evaluated from the results of the tensile test of the strips for property evaluation. F was defined as the load. $S_0$ was defined as the initial cross-sectional area of the test specimen. $L_0$ was defined as the initial longitudinal length. ΔL was defined as the elongation from the beginning in the test. The conventional stress $\sigma_n$ was the value in which the load F was divided by the initial cross-sectional area. The normal strain $\varepsilon_n$ was the value in which the elongation ΔL was divided by the initial longitudinal length $L_0$.

The true stress $\sigma_t$ and the true strain $\varepsilon_t$ were calculated based on the formulae below, where $\sigma_t$ was defined as the stress taking the cross-sectional area of the test specimen during deformation into consideration and $\varepsilon_t$ was defined as the strain taking the longitudinal length during deformation.

$$\sigma_t=\sigma_n(1+\varepsilon_n)$$

$$\varepsilon_t=\ln(1+\varepsilon_n)$$

$$(d\sigma_t/d\varepsilon_t)$$

$d\sigma_t/d\varepsilon_t$ was calculated from the data of the true stress $\sigma_t$ and the true strain $\varepsilon_t$ obtained as explained above; and a graph as shown in FIG. 1 was produced with $\varepsilon_t$ as the horizontal axis and $d\sigma_t/d\varepsilon_t$ as the vertical axis. Here, the displacement amount of the true strain $\varepsilon_t$ every 0.01 s was defined as $d\varepsilon_t$, and the change of the true stress $\sigma_t$ every 0.01 s was defined as $d\sigma_t$. The test specimen, the graph of which had a region of a positive slope $d\sigma_t/d\varepsilon_t$ (region with an increasing $d\sigma_t/d\varepsilon_t$), was graded as "A." The test specimen, the graph of which had not a region of a positive slope $d\sigma_t/d\varepsilon_t$, was graded as "B." The evaluation results are shown in Table 3.

In addition, the slope of $d\sigma_t/d\varepsilon_t$ was obtained; and the maximum among the values of $d\sigma_t/d\varepsilon_t$, at which the slope was 0 where the slope was changed from positive to negative, was obtained as the local maximum. In addition, the minimum among the values of $d\sigma_t/d\varepsilon_{t,t}$, at which the slope was 0 where the slope was changed from negative to positive, in the region of the true strain $\varepsilon_t$ less than the above-described local maximum was obtained as the local minimum. The rise value of $d\sigma_t/d\varepsilon_t$ was defined as the difference between the local maximum and the local minimum. The evaluation results are shown in Table 3.

(Electrical Conductivity)

A test specimen having a width of 10 mm and a length of 150 mm was sampled from the strip material for characteristic evaluation, and the electric resistance was obtained using a four-terminal method. In addition, the dimensions of the test specimen were measured using a micrometer, and the volume of the test specimen was computed. In addition, the electrical conductivity was calculated from the measured electric resistance and the volume. Meanwhile, the test specimen was sampled so that the longitudinal direction of the test specimen became parallel to the rolling direction of the strip material for characteristic evaluation.

Evaluation results are shown in Table 3.

(Bendability)

Bending working was carried out on the basis of the method of Japan Copper and Brass Association Technical Standard JCBA-T307:2007, the testing method 4.

Multiple test specimens having a width of 10 mm and a length of 30 mm were sampled from the strip for characteristic evaluation so that the bending axis became parallel with respect to the rolling direction; and a W bending test was carried out using a W-shaped jig having the bending angle of 90° and the bending radius corresponding to 1.5 times of each plate thickness.

When a crack was observed visually, the test specimen was graded as "B." When a crack was not observed visually, the test specimen was graded as "A." Evaluation results are shown in Table 3.

TABLE 1

| | | Mg mass % | P ppm | Sn ppm | H ppm | O ppm | O ppm | Cu |
|---|---|---|---|---|---|---|---|---|
| Example of the present invention | 1 | 0.11 | — | — | 0.2 | 2 | 4 | balance |
| | 2 | 0.17 | — | — | 0.3 | 4 | 5 | balance |
| | 3 | 0.21 | — | — | 0.5 | 1 | 12 | balance |
| | 4 | 0.24 | 98 | — | 0.5 | 1 | 3 | balance |
| | 5 | 0.25 | — | — | 0.2 | 1 | 5 | balance |
| | 6 | 0.26 | — | 900 | 0.3 | 1 | 5 | balance |
| | 7 | 0.29 | 40 | — | 0.9 | 2 | 4 | balance |
| | 8 | 0.32 | — | 350 | 0.2 | 1 | 5 | balance |
| | 9 | 0.34 | 2 | — | 0.3 | 9 | 5 | balance |
| | 10 | 0.35 | 15 | 80 | 0.2 | 1 | 27 | balance |
| | 11 | 0.39 | — | — | 1.6 | 2 | 5 | balance |
| | 12 | 0.43 | — | — | 0.2 | 3 | 3 | balance |
| | 13 | 0.47 | — | 40 | 0.2 | 1 | 5 | balance |
| | 14 | 0.49 | — | — | 0.6 | 1 | 3 | balance |
| | 15 | 0.40 | — | 11 | 0.5 | 1 | 3 | balance |
| | 16 | 0.41 | — | — | 3.7 | 4 | 4 | balance |
| | 17 | 0.38 | — | — | 0.3 | 2 | 48 | balance |
| | 18 | 0.12 | 17 | — | 0.3 | 2 | 3 | balance |
| | 19 | 0.26 | 19 | — | 0.4 | 1 | 4 | balance |
| | 20 | 0.48 | 16 | — | 0.4 | 1 | 3 | balance |
| | 21 | 0.25 | 1 | — | 0.3 | 1 | 5 | balance |
| | 22 | 0.13 | 48 | — | 0.4 | 3 | 3 | balance |
| | 23 | 0.26 | 45 | — | 0.2 | 1 | 4 | balance |
| | 24 | 0.31 | 53 | — | 0.3 | 2 | 3 | balance |
| | 25 | 0.37 | 61 | — | 0.2 | 1 | 3 | balance |
| Comparative Example | 1 | 0.02 | — | — | 0.4 | 1 | 4 | balance |
| | 2 | — | 3400 | 61000 | 0.5 | 1 | 6 | balance |
| | 3 | 0.72 | — | — | 0.4 | 4 | 5 | balance |
| | 4 | 0.35 | — | — | 0.2 | 2 | 4 | balance |

TABLE 2

| | | Heat treatment | | Intermediate rolling 1 | Intermediate heat treatment 1 | | Intermediate rolling 2 | Intermediate heat treatment 2 | | Intermediate rolling 3 | Intermediate heat treatment 3 | |
|---|---|---|---|---|---|---|---|---|---|---|---|---|
| | | Temperature (° C.) | Time (min) | Rolling rate (%) | Temperature (° C.) | Time (min) | Rolling rate (%) | Temperature (° C.) | Time (min) | Rolling rate (%) | Temperature (° C.) | Time (min) |
| Example of the present invention | 1 | 850 | 4 | 40 | 750 | 30 | 40 | 550 | 30 | 35 | 550 | 1 |
| | 2 | 850 | 4 | 50 | 650 | 60 | 50 | 550 | 30 | 60 | 550 | 1 |
| | 3 | 850 | 4 | 60 | 650 | 60 | 50 | 550 | 60 | 60 | 500 | 1 |
| | 4 | 850 | 4 | 60 | 750 | 60 | 60 | 550 | 60 | 45 | 600 | 5 |
| | 5 | 850 | 4 | 50 | 750 | 90 | 50 | 550 | 60 | 80 | 610 | 1 |
| | 6 | 850 | 4 | 50 | 750 | 60 | 50 | 600 | 60 | 60 | 620 | 1 |
| | 7 | 850 | 4 | 60 | 700 | 60 | 50 | 575 | 30 | 60 | 550 | 5 |
| | 8 | 850 | 4 | 50 | 750 | 30 | 40 | 575 | 60 | 60 | 600 | 2 |
| | 9 | 850 | 4 | 40 | 750 | 60 | 50 | 625 | 30 | 60 | 650 | 1 |
| | 10 | 850 | 4 | 30 | 750 | 60 | 50 | 625 | 60 | 60 | 625 | 1 |
| | 11 | 850 | 4 | 70 | 800 | 60 | 60 | 650 | 30 | 60 | 650 | 1 |
| | 12 | 850 | 4 | 70 | 800 | 60 | 50 | 650 | 60 | 60 | 700 | 1 |
| | 13 | 850 | 4 | 60 | 750 | 60 | 50 | 600 | 60 | 55 | 650 | 1 |
| | 14 | 850 | 4 | 60 | 750 | 60 | 50 | 600 | 60 | 60 | 600 | 2 |
| | 15 | 850 | 4 | 60 | 750 | 60 | 50 | 600 | 30 | 50 | 550 | 2 |
| | 16 | 850 | 4 | 60 | 750 | 60 | 50 | 600 | 30 | 50 | 600 | 5 |
| | 17 | 850 | 4 | 60 | 750 | 60 | 50 | 600 | 30 | 50 | 525 | 5 |
| | 18 | 850 | 4 | 60 | 750 | 60 | 50 | 550 | 30 | 60 | 550 | 2 |
| | 19 | 850 | 4 | 60 | 750 | 60 | 50 | 550 | 30 | 60 | 600 | 1 |
| | 20 | 850 | 4 | 50 | 750 | 90 | 50 | 600 | 60 | 60 | 600 | 5 |
| | 21 | 850 | 4 | 50 | 750 | 60 | 50 | 575 | 60 | 50 | 600 | 1 |

TABLE 2-continued

| | | Heat treatment | | Intermediate rolling 1 | Intermediate heat treatment 1 | | Intermediate rolling 2 | Intermediate heat treatment 2 | | Intermediate rolling 3 | Intermediate heat treatment 3 | |
|---|---|---|---|---|---|---|---|---|---|---|---|---|
| | | Temperature (° C.) | Time (min) | Rolling rate (%) | Temperature (° C.) | Time (min) | Rolling rate (%) | Temperature (° C.) | Time (min) | Rolling rate (%) | Temperature (° C.) | Time (min) |
| | 22 | 850 | 4 | 50 | 750 | 30 | 50 | 550 | 30 | 50 | 550 | 1 |
| | 23 | 850 | 4 | 50 | 750 | 60 | 50 | 550 | 30 | 50 | 600 | 5 |
| | 24 | 850 | 4 | 60 | 750 | 60 | 40 | 575 | 30 | 50 | 550 | 5 |
| | 25 | 850 | 4 | 40 | 800 | 30 | 50 | 600 | 60 | 45 | 650 | 1 |
| Comparative Example | 1 | 850 | 4 | 50 | 750 | 30 | 60 | 550 | 30 | 40 | 700 | 1 |
| | 2 | 750 | 4 | 40 | 750 | 60 | 50 | 550 | 30 | 50 | 600 | 30 |
| | 3 | 850 | 8 | 50 | 750 | 30 | 60 | 650 | 60 | 70 | 610 | 1 |
| | 4 | 850 | 4 | 95 | 550 | 1 | — | — | — | — | — | — |

TABLE 3

| | | Crystal grain size before the finish working (μm) | | Finish rolling Rolling rate (%) | Finish heat treatment | | Final plate thickness (mm) | Yield strength (MPa) | | Electrical conductivity (% IACS) | $d\sigma_t/d\varepsilon_t$ | | Bend-ability |
|---|---|---|---|---|---|---|---|---|---|---|---|---|---|
| | | Average | Standard deviation | | Temperature (° C.) | Time (min) | | Before the finish heat treatment | After the finish heat treatment | | Presence or absence of the region having a positive slope | Rise value (MPa) | |
| Example of the present invention | 1 | 5.3 | 0.6 | 45 | 375 | 60 | 1.0 | 384 | 337 | 87.8 | A | 53 | A |
| | 2 | 6.5 | 1.2 | 45 | 450 | 5 | 0.5 | 421 | 354 | 87.0 | A | 89 | A |
| | 3 | 2.2 | 0.3 | 65 | 300 | 5 | 1.0 | 468 | 431 | 85.0 | A | 35 | A |
| | 4 | 10.5 | 3.7 | 70 | 400 | 40 | 0.5 | 489 | 450 | 83.7 | A | 46 | A |
| | 5 | 8.2 | 4.5 | 35 | 450 | 10 | 0.5 | 375 | 326 | 82.5 | A | 74 | A |
| | 6 | 12.3 | 5.2 | 70 | 400 | 60 | 2.0 | 512 | 435 | 76.2 | A | 103 | A |
| | 7 | 4.3 | 1.0 | 80 | 350 | 600 | 1.0 | 546 | 480 | 79.5 | A | 153 | A |
| | 8 | 10.2 | 3.3 | 80 | 400 | 60 | 0.5 | 546 | 491 | 76.3 | A | 231 | A |
| | 9 | 23.4 | 7.8 | 80 | 375 | 180 | 1.0 | 531 | 495 | 78.2 | A | 250 | A |
| | 10 | 14.6 | 4.4 | 80 | 400 | 60 | 2.0 | 553 | 492 | 76.0 | A | 302 | A |
| | 11 | 35.1 | 7.3 | 60 | 425 | 60 | 1.0 | 538 | 501 | 74.3 | A | 231 | A |
| | 12 | 68.4 | 9.4 | 45 | 400 | 60 | 1.0 | 490 | 478 | 72.3 | A | 101 | A |
| | 13 | 20.1 | 6.3 | 55 | 400 | 60 | 0.5 | 526 | 510 | 70.3 | A | 135 | A |
| | 14 | 6.5 | 3.3 | 55 | 375 | 60 | 0.5 | 554 | 529 | 70.1 | A | 97 | A |
| | 15 | 7.3 | 3.2 | 55 | 400 | 5 | 1.0 | 550 | 524 | 73.8 | A | 132 | A |
| | 16 | 16.5 | 5.2 | 60 | 400 | 10 | 1.0 | 473 | 423 | 74.2 | A | 110 | A |
| | 17 | 8.4 | 2.1 | 60 | 400 | 60 | 1.0 | 471 | 420 | 74.6 | A | 142 | A |
| | 18 | 5.1 | 0.7 | 50 | 400 | 5 | 1.0 | 390 | 341 | 87.7 | A | 62 | A |
| | 19 | 6.3 | 2.1 | 60 | 400 | 10 | 1.0 | 482 | 427 | 83.1 | A | 82 | A |
| | 20 | 13.6 | 3.9 | 50 | 400 | 10 | 0.5 | 506 | 473 | 71.3 | A | 102 | A |
| | 21 | 7.5 | 3.3 | 40 | 400 | 5 | 1.0 | 398 | 345 | 83.0 | A | 43 | A |
| | 22 | 4.0 | 0.8 | 60 | 400 | 5 | 1.0 | 393 | 321 | 88.3 | A | 68 | A |
| | 23 | 7.3 | 2.2 | 50 | 350 | 10 | 1.0 | 453 | 410 | 82.7 | A | 52 | A |
| | 24 | 3.1 | 0.7 | 50 | 400 | 10 | 1.0 | 469 | 408 | 78.9 | A | 63 | A |
| | 25 | 28.4 | 8.8 | 80 | 350 | 600 | 0.5 | 529 | 487 | 75.0 | A | 156 | A |
| Comparative Example | 1 | 78.5 | 12.1 | 75 | 375 | 10 | 0.5 | 313 | 212 | 97.1 | B | — | A |
| | 2 | 34.6 | 8.0 | 90 | 450 | 10 | 0.5 | 780 | 380 | 15.9 | A | 103 | A |
| | 3 | 11.3 | 3.3 | 85 | 450 | 10 | 0.5 | 551 | 521 | 60.4 | A | 285 | A |
| | 4 | 26.4 | 30.5 | 90 | 300 | 60 | 1.0 | 583 | 521 | 75.6 | B | — | B |

In Comparative Example 1, the Mg content was less than the range of the scope of the present invention, and the 0.2% yield strength was significantly decreased after the finish heat treatment.

Comparative Example 2 was made of phosphor bronze and heat resistance was insufficient. Thus, 0.2% yield strength was significantly decreased after the finish heat treatment.

In Comparative Example 3, the Mg content exceeded the range of the scope of the present invention, and the electrical conductivity decreased.

In Comparative Example 4, the second intermediate working and the second intermediate heat treatment were not performed. Thus, the standard deviation of the crystal grain size before the finish working and the finishing heat treatment exceeded the average grain size d. Thus, no region in which the $d\sigma_t/d\varepsilon_t$ increased was observed. For this reason, the bendability was insufficient.

In contrast, in Examples of the present invention, the average grain size before the finish working and the finish heat treatment was 2 μm or more, and the standard deviation of the crystal grain size equaled to d or less when the average grain size was defined as d. After the finish heat treatment, the region, in which the $d\sigma_t/d\varepsilon_t$ was increased, was observed, and the bendability was excellent.

Based on the evaluation results described above, according to Examples of the present invention, it was demonstrated that a copper alloy for an electronic and electrical device and a plastically-worked copper alloy material for an electronic and electric device, both of which had a high bendability and a high 0.2% yield strength, could be provided.

INDUSTRIAL APPLICABILITY

A copper alloy for an electronic and electric device; a plastically-worked copper alloy material for an electronic and electric device; a component for an electronic and electric device; a terminal; and a busbar, each of which has particularly excellent bendability and high electrical conductivity, can be provided.

The invention claimed is:

1. A copper alloy for an electronic and electric device comprising:

Mg in a range of 0.1 mass % or more and less than 0.5 mass %; and a Cu balance including inevitable impurities, wherein a strained region having a positive slope of $d\sigma_t/d\varepsilon_t$ is presented in a graph, in which a vertical axis is $d\sigma_t/d\varepsilon_t$ and a horizontal axis is a true strain $\varepsilon_t$, $d\sigma_t/d\varepsilon_t$ being defined by a true stress $\sigma_t$ and the true strain $\varepsilon_t$, which are obtained in a tensile test of the copper alloy.

2. The copper alloy for an electronic and electric device according to claim 1, wherein the electrical conductivity is 70% IACS or more.

3. The copper alloy for an electronic and electric device according to claim 1, wherein a rise value of the $d\sigma_t/d\varepsilon_t$ is 30 MPa or more.

4. The copper alloy for an electronic and electric device according to claim 1, further comprising P in a range of 1 mass ppm or more and less than 100 mass ppm.

5. The copper alloy for an electronic and electric device according to claim 1, further comprising Sn in a range of 10 mass ppm or more and less than 1000 mass ppm.

6. The copper alloy for an electronic and electric device according to claim 1, wherein a H content is less than 4 mass ppm, an O content is less than 10 mass ppm, and a S content is less than 40 mass ppm.

7. A plastically-worked copper alloy material for an electronic and electric device made of the copper alloy for an electronic and electric device according to claim 1.

8. A component for an electronic and electric device made of the plastically-worked copper alloy material for an electronic and electric device according to claim 7.

9. A terminal made of the plastically-worked copper alloy material for an electronic and electric device according to claim 7.

10. A busbar made of the plastically-worked copper alloy material for an electronic and electric device according to claim 7.

* * * * *